United States Patent [19]

Reccius

[11] Patent Number: 4,955,222

[45] Date of Patent: Sep. 11, 1990

[54] DEFORMING PANELS HAVING RIBS

[75] Inventor: Helmut Reccius, Munich, Fed. Rep. of Germany

[73] Assignee: Dornier Luftfahrt GmbH, Friedrichshafen, Fed. Rep. of Germany

[21] Appl. No.: 324,548

[22] Filed: Mar. 16, 1989

[30] Foreign Application Priority Data

Mar. 16, 1988 [DE] Fed. Rep. of Germany ..... 3808763

[51] Int. Cl.[5] ..... B21D 11/20

[52] U.S. Cl. ..... 72/295; 72/302; 72/379.2

[58] Field of Search ..... 72/48, 295, 298, 301, 72/302, 303, 215, 216, 379, 407, 409, 479; 29/238, 252, 261

[56] References Cited

U.S. PATENT DOCUMENTS

| | | | |
|---|---|---|---|
| 791,032 | 5/1905 | Killian | 29/262 |
| 2,560,929 | 7/1951 | Calbeck | 29/238 |
| 3,296,119 | 9/1942 | Ringrose | 29/262 |
| 3,395,563 | 8/1968 | Ribback | 72/408 |
| 3,888,104 | 6/1975 | Ribback | 72/407 |
| 3,927,548 | 12/1975 | Lannin | 72/412 |
| 4,498,325 | 2/1985 | Reccius et al. | 72/395 |

FOREIGN PATENT DOCUMENTS

| | | | |
|---|---|---|---|
| 40633 | 2/1988 | Japan | 72/407 |
| 755376 | 8/1980 | U.S.S.R. | 72/379 |

*Primary Examiner*—Robert L. Sprull
*Attorney, Agent, or Firm*—Ralf H. Siegemund

[57] ABSTRACT

A device for the bending and deformation of panels such as skin elements for covering cells of vehicles in the aerospace industry such as aircraft, rocket space vehicles or the like, the skin elements having inwardly directed stiffening ribs which intersect in nodes; the device has first and second deforming members being capable of engaging the skin element in points adjacent to nodes under consideration of length changes obtained by some of the ribs; the two deforming members are adjustable in relation to each other and other through a variable armature mount such that the deforming forces respectively provided into the part to be deformed are oriented in the area of the nodes transversely or nearly transversely to those ribs which extend transversely to the curvature to be obtained and consistently tangentially to the panel part in the direction of curvature and following change of curvature on account of bending; and the direction of force action as provided by the deforming members into the work part is varied such that these forces as provided by the two deforming members do not have to act coaxially in relation to each other.

16 Claims, 2 Drawing Sheets

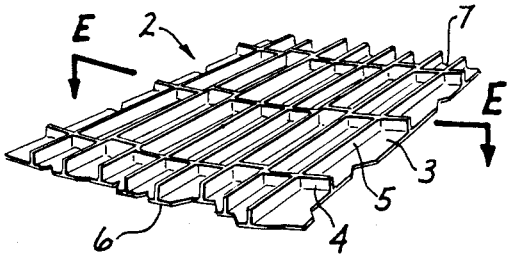
FIG. 1
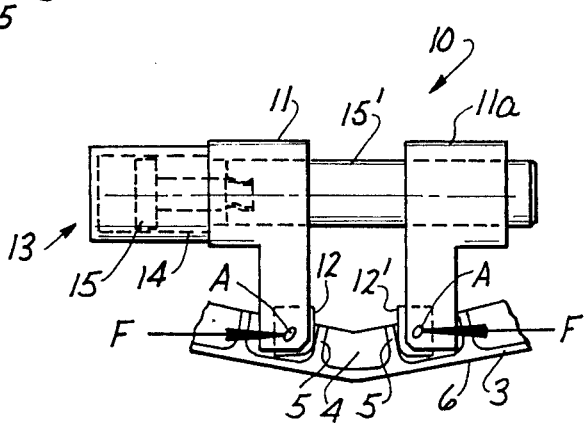
FIG. 2
FIG. 3
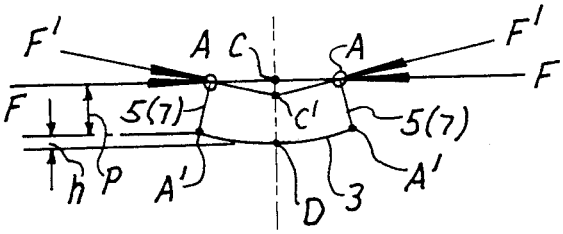
FIG. 4
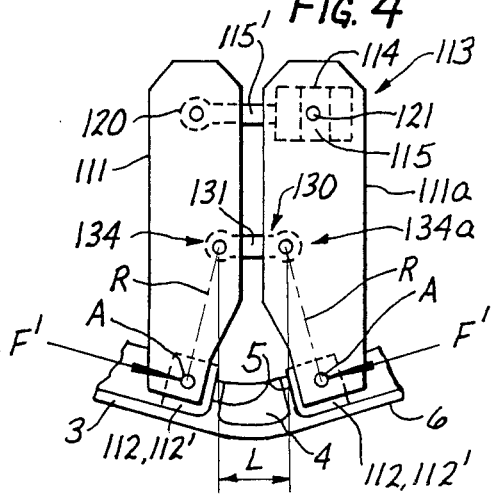
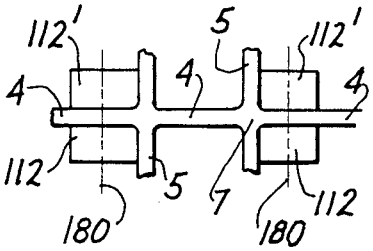
FIG. 4a

DEFORMING PANELS HAVING RIBS

BACKGROUND OF THE INVENTION

The present invention relates to the bending of panels particularly panels to be used as skin for covering a cell within the structure of aircraft, rocket space vehicles or the like. The invention refers specifically to a device for bending panels of the type referred to above wherein the skin on one side carries stiffening ribs forming intersections or nodes and the device for obtaining bending and curving includes adjustable elements and deforming tool members which are operated under exertion of adequate force in order to obtain positive action under utilization of the location of adjacent nodes of the work and under consideration of changes in length wherein those ribs which run in the direction of curvature.

Panels of the types to which the invention pertains and particularly the bending of such panels requires working certain material which has a certain elasticity and plastic behaviour. A conventional material used here is aluminum. Parts are worked in this fashion particularly are required not only to have low weight but to provide low drag resistance as far as air flow is concerned which means that the panel outside has to be as smooth as possible and must not have any bumps, corners or the like, but there should be gradual and smooth transitions and curvature wherever needed, to be as streamlined as possible in order to avoid formation of drag resistance points for air-flow. In addition, such parts should be made in an economic fashion. Panels of the type to which the invention pertain may either be provided with integrated ribs etc. or ribs, strings or the like may have been added subsequently e.g. through rivetting or the like.

European patent No. 78 891 B1 suggests a method and equipment for bending panels particularly for covering cells in aerospace vehicles wherein deformation obtains through plastic straight line length changes of the ribs extending in the direction of curving and wherein the deforming forces in the ribs are provided at such a distance from the skin itself so that the tension in the panel results in a neutral line within the skin.

The present invention refers specifically to improvements in methods and practice as per this particular European patent and has as its specific task to improve equipment such that in between two adjacent nodes of the stiffening ribs the panel and transverse ribs be subjected to bending. These latter ribs are subject to length extension following the deforming. After the deformation process over entire extension has been completed, these ribs are provided with a constant or uniform stress distribution.

DESCRIPTION OF THE INVENTION

It is an object of the present invention to provide a new and improved method and equipment for bending panels to be used in curved skin parts in the aerospace industry, wherein crisscrossing ribs are provided on the inside of the skin and the ribs form intersections and nodes and whereby the deformation is provided through deforming members acted upon these ribs with adequate force for forceful engagement of the skin particularly adjacent to the nodes to obtain an adequate change in curvature right in between these nodes.

In accordance with the preferred embodiment of the present invention it is suggested to provide for independently adjustable deforming members such that the deforming force acts consistently perpendicular on e.g. two ribs which extend transversely to the plane of bending while a rib insert plane undergoes a length change; these forces act near intersection nodes of ribs to be effective at least approximately tangentially to the panel near foot points of the ribs accordingly. In addition, structure is provided to change the direction of bending forces as effective on the part being bent.

The inventive equipment permits the introduction of the deforming forces in the work piece in a manner that can be changed, particularly in regard to the direction of forces effective right at those ribs or rib portions which will undergo length changes on account of the deformation. Hence the direction of force attack for bending is to be subject to control and adjustment so that an inherent tension distribution obtains within the ribs which is uniform over the entire extension of such rib between two adjacent or adjoining nodes.

The insertion and introduction of force therefore can be obtained transversely to those ribs which extend transversely to the direction of curvature and that means at right angles to the line between the respective pivot axis of the pivotable deforming member of the working tool on one hand and the point of attack of the force as these members act on the workpiece through pivotal brackets.

Owing to the pivotability of bracket pairs or the deformation tool members it is possible to rapidly match the orientation of these pairs in relation to the part to be deformed and that may differ during the deformation process corresponding to the desired degree of deformation. Hence, as introduction of force in the work obtains that can compensate certain escapement movements of the tool but also of the workpiece itself whereby the matching of the brackets to the varying direction of engagement with the ribs during the deformation process is permissible namely in dependence upon the instantaneous disposition and orientation of the ribs.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a somewhat schematic view of a panel to be deformed in accordance with the method of the present invention but not having been deformed at this point in time;

FIG. 2 is a somewhat schematic view of the deforming device in accordance with the state of the art showing deformation, position and direction of force insertion;

FIG. 3 is a force diagram showing the introduction of deforming forces into the work and comparing the known operation with the operation in accordance with the inventive methods;

FIG. 4 is a somewhat schematic view of the device for practicing the inventive method and showing novel equipment including particularly specifics for introduction of force into the work;

FIG. 4*a* is a somewhat schematical a section view of a panel under inclusion of the action provided by the device shown in FIG. 4;

Proceeding now to the detailed description of the drawings, FIG. 1 shows a panel 2 having a skin part 3 with crossing stiffening ribs 4 and 5 whereby the ribs 4 are particularly spaced apart and run in one direction and the ribs 5 are more closely spaced to each other and run transversely to the direction of the ribs 4.

Figure 5:
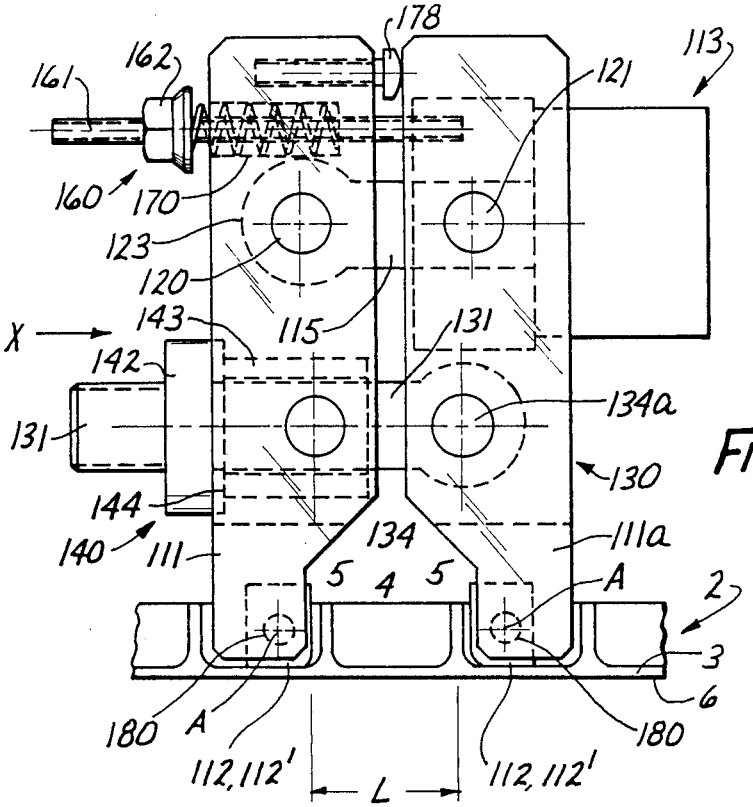
FIG. 5 shows the device in accordance with FIG. 4 in greater detail and a side elevation.

By way of example the panel 2 may be a skin and cover part for a cell in an aerospace type of vehicle. It is assumed moreover that curving is to be provided for matching the particular skin part to the curvature of the cell at a particular surface portion. Owing to such a curvature it is inherent that these ribs one group or the other or both have to undergo certain length extension whereby it is assumed that the ribs 4 may undergo these length extensions.

The outer surface of the panel 3 is identified by reference numeral 6 and is assumed to be smooth i.e. the ribs 4, 5 extend from the other surface of panel 3 and into the interior of the cell of the space vehicle or aircraft.

Reference numeral 7 denotes various nodes in points of intersection of any rib 4 with any of the ribs 5. The nodes 7 may be configured to be in fact formed by only portions of the ribs 4 and 5. In other words for instance ribs 5 are just studs of certain relatively short portions which extend laterally from each of these nodes 7 to both sides thereof and of course transversely to the respective rib 4, but the extensions of ribs 5 from respective node to adjacent node in the direction of extension of such a rib 5 (or a hypothetical extension thereof) is not necessarily a continuous one. This is a feature which permits or facilitates engagement of the tooling.

Proceeding now to the description of FIG. 2 it shows a deforming device in accordance with the state of the art. The device 10 includes deforming members 11 and 11*a* having free ends carrying clamping bracket pairs 12 and 12' for engagement with two spaced ribs 5 of the workpiece 2. The deforming members 11 and 11*a* are arranged with respect to a carrier 15' and an axis which constitutes also the axis of a piston 15 for a working piston, cylinder drive of a hydraulically operated servomotor 13.

The servo motor 13 moves the piston 15 within a cylinder housing 14 under formation of cylinder chambers, and the piston can move axially in that chamber. The deformation member 11 in this particular case is connected securely to the cylinder casing 14. Member 11*a* is connected with a piston rod for piston 15 so that upon operating the servomotor 13 through a pressure medium control (not shown), the deforming members operate parallel to each other and in a colinear relation. This means that the deforming forces F acting in points A adjacent to a node 7 will be and remain coaxial in relation to each other. The direction of forces of coaxially but opposing deforming forces F thus remains in relation to the workpiece 2 independent from the bending state and progress obtained through these forces as far as the workpiece 2 is concerned.

Owing to the linear transmission of the deforming forces F on the piece 2 there will then be an unequal distribution of bending moments produced upon the section between two adjacent nodes and pertaining to the continuous rib 5 that extends between these two nodes obtaining of course length change. Consequently there is a concentration of inherent tension in the workpiece in conjunction with a nonuniform curvature resulting in the skin 3 and, therefore, there will be a nonuniform state of the panel as it is placed into the aircraft on one hand and as far as the outer surface 6 is concerned that is subjected to the ambient air flow.

FIG. 3 shows in a diagram the particular forces F obtain in prior art practice but superimposed are other forces, F' being introduced for providing basically the same deformation of the panel 2 but they are oriented in an angle in relation to each other and to two particular ribs 5*b*. The forces F' are no longer in coaxial relation to each other. They act points A of the workpiece and produce a particular state of deformation in the rib 5 such that the radius R between a pivot axis of a pivotable deforming member and the point A of force insertion has a right angle.

A' denotes the respected foot portion of any of the two ribs 5 as well as of the interconnecting ribs 4. These foot points are of course situated in (on) the skin 3. The letter p denotes the bending distance of the points (A) of action by deforming forces F (or F') from the nearest foot point A'. h denotes the differential distance between two foot points A' and the curvature center apex point D of skin 3 in between these points and in a particular given state of curvature as far as the work piece 2 is concerned. The geometric difference between the point C and C' in the line of action of the coaxial oriented forces (prior art) F vis-a-vis the noncoaxial forces F' (invention) shows and demonstrates the difference between the bending tension effective during the deformation in the ribs 4 and in the particular state of deformation and resulting from the different directions of the forces F vis-a-vis the forces F'. In other words one can readily see the difference which the invention makes.

Turning to FIG. 4 showing an example of the inventive configuration the deforming members are denoted with the reference numerals 111 and 111*a*. They can be pivoted in relation to each other to thereby change the orientation to each side. In the range of one respective end of each of these members 111 and 111*a*. Clamping bracket pairs 112 and 112' are provided in principle just as in the known device as shown in FIG. 2 for engagement with the workpiece. However, the bracket members 112 and 112' are pivotally mounted. They grip two ribs from opposite sides and hold a rib 4 which is to be deformed in between. Brackets 112, 112' act in a contour matching fashion in between adjacent nodes 7 of the panel (see FIG. 4*a*). The servo motor 113 acts on the other ends of the deforming members 111, 111*a*. Here there is a working piston 115 which bears against the deforming member 111 while a working cylinder 114 receiving the piston 115 is hingedly and pivotably supported on the deforming member 111*a*. 123 denotes an eye of the working piston.

A connecting and support device 130 is arranged between the clamping bracket pairs 112 and 112' and the servo motor 113. The connection and support 130 is so disposed with reference to the longitudinal extension of the deforming members 111 and 111*a*. Otherwise connection and support 130 extends between members 111 and 111*a*. The connection and support 130 serves as support and as separate pivot mount for maintaining the pivoting relation of the deforming members 111 and 111*a* in relation to each other but independent from each other, such pivoting is to be in a direction within the pivot plane E—E as shown in FIG. 1. Cylinder 114 as well as piston 115 of motor 113 are hinged through pivot mounts 120 and 121 respectively to the deforming members 111 and 111*a* to obtain that pivoting.

Figure 6:
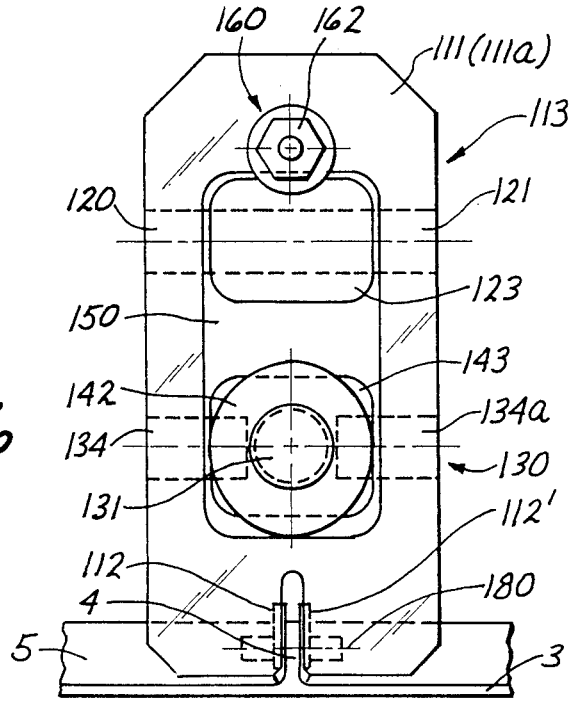
FIG. 6 is a view of the device as seen in the direction of arrow X in FIG. 5.

The support 130 carries the deforming members 111 and 111*a* through pivot mounts 134 and 134*a* respectively. Armature 130 includes moreover adjusting structure for changing the distance L between the two pivots of mounts 134 respectively on the deforming members 111 and 111*a*. That in turn is effective as a change in direction of the acting forces F'. Further details of this adjustment can be taken from FIGS. 5 and 6. FIG. 4 is a somewhat simplified schematic showing of the construction shown in detail in FIGS. 5 and 6. Similar parts are denoted with the same reference numerals. As shown in these construction drawings FIG. 5 and 6 the deforming members 111 and 111*a* each are configured as a kind of closed frame with a certain opening 150 for receiving the parts and components of the servo motors 113 as well as parts and components of the support 130 and related pivot mount elements. It is thus stated above generally and can now be stated differently that the clamping bracket pairs 112 and 112' respectively bear against the frame established by the members 111 and 111*a*.

The adjusting device 140 for adjusting the length L between pivot mounts 134, 134*a* includes a threaded ring 142 which can be threaded on the threading of the armature rod 131. Moreover, the device 140 can be securely locked in any adjusting position. The ring 142 bears against a shoulder 144 of a sleeve 143 which on one hand carries the pivot pins of the bearing and pivot mounts 134 and 134*a* on one hand and is slidable on the rod 131 on the other hand. Depending on the adjustment of the threaded ring 142, adjustment of the distance L defined above obtains as between the pivot axes for the two bearing mounts 134 and 134*a* and that of course is the basis of reorienting the two members 111 and 111*a* in a different and follow-up manner. For the same adjustment position of the servo motor, one obtains variations in the directions of the two forces F'.

It follows from the foregoing that the deforming force F' will always act on points A adjacent to the ribs 4 but depending on the configuration of the part 2 these forces in fact pivot during the deformation process. This pivoting is to be understood as a change in direction as between the beginning and end of the deformation based on the position of the members 111 and 111*a* in relation to each other and being understood further to occur perpendicular to the extension of the ribs 5 which is also at right angles in relation to the pivot radius about which the deformation members 111 and 111*a* are pivotable.

In lieu of the illustrated adjusting device 142, 143 and 131 for changing the distance L one could configure differently the arrangement by means of which position changes obtain as far as 134 and 134*a* are concerned and with reference to and in conjunction with the connection and support 130 and concerning the direction the longitudinal extension of the working and forming tool elements 111 and 111*a*. Such a change in the distance between the action point A of the deforming forces F' on one hand and the axes of the pivot mounts and bearings 134, 134*a* on the other hand entails a change in the radius R and that in turn permits the utilization of devices for the deforming parts having different dimensions.

The device furthermore is comprised of a lift or stroke limiter 160. This limiting device includes a fixedly positioned screw 161 positioned in said fashion in one of the working tool members namely 111*a* and in addition an adjusting nut 162 is threaded onto the screw and providing for the adjustment of this limiting and stop function. Moreover, a spring biased device 160 is included bearing on one hand against the nut 162 of the limiting device 160. In addition the spring bears against a blind bore or should be in 111. This spring serves to hold the deforming members 111 and 111*a* in a particular open position whenever no pressure is applied to the adjusting motor 113. This situation results in a particular zero position and is provided in such a manner that the insertion and inclusion of parts to be worked is facilitated.

It should be noted that the tool as such can be constructed as a movable tool or as a component in a stationary machinery equipment. The embodiment illustrated here includes, as stated the clamping bracket pairs 112 and 112' respectively on the deforming members 111 and 111*a* and are pivotable about axes 180 transversely to the direction of forced action F'. Owing to the thus mounted clamping bracket pairs 112 and 112' and during the entire deformation there is automatic matching to the disposition, and the degree of deforming for the rib 5 obtains and has maintained over the entire deforming process with certainty. Hence, the deforming forces F' are subject to transmission without interference and can act in that fashion on and in the work 2. Finally it should be mentioned that reference numeral 178 refers to an adjusting screw by means of which the opening path can be limited in an adjustable fashion.

The invention is not limited to the embodiments described above but all changes and modifications thereof, not constituting departures from the spirit and scope of the invention, are intended to be included.

I claim:

1. Device for the bending and deformation of panels for covering cells of vehicles in the aerospace industry, said having inwardly directed stiffening ribs which intersect in nodes, the device having first and second deforming members being capable of engaging said panels in points adjacent to nodes under consideration of length changes obtained by some of the ribs; the improvement comprising:

said deforming members carrying clamping bracket pairs for engagement of adjacent nodes, said clamping bracket pairs being freely pivotable under utilization of pivot pins arranged transversely to the plane of pivoting;

means connected to said device for applying forces to the deforming members so that the deforming members are enabled to obtain the bending and deformation of the respective panel; and means for independently adjusting the orientation of said two deforming members in relation to each other such that the deforming forces respectively provided into the respective panel to be deformed are oriented in the area of the nodes transversely or nearly transversely to those ribs which extend transversely to the curvature to be obtained and consistently tangentially to the panel in the direction of curvature and following change of curvature on account of bending; and means for varying the direction of force action as provided by said deforming members into the panel such that these forces as provided by said two deforming members do not have to act coaxially in relation to each other.

2. Device in accordance with claim 1 there being pivot mounts for said deforming members mounting them in relation to each other.

3. The improvement as in claim 1, there being a common armature element, said deforming members being separately pivoted on said armature.

4. The improvement as in claim 3, each of said deforming members having its own pivot mount on said common armature.

5. The improvement as in claim 4, including means for changing the distance between the pivot mounts to thereby adapt the device to different distances between adjacent nodes of the stiffening ribs.

6. The improvement as in claim 4, including means for changing the pivot radius of the deforming members on the respective pivot mounts and in relation to the action point of the deforming members on the panel.

7. The improvement as in claim 4, including means for varying the distance in a follow-up configuration between the pivot mounts on the armature.

8. The improvement as in claim 1, wherein said means for applying forces includes a servo motor pivotally mounted and connected to said deforming members.

9. Device for the bending and deformation of panels for covering cells of vehicles in the aerospace industry, said panels having inwardly directed stiffening ribs which intersect in nodes, the device having first and second deforming members being capable of engaging said panel in points adjacent to nodes under consideration of length changes obtained by some of the ribs; the improvement comprising:

means for independently pivotally mounting the orientation of said two deforming members such that the deforming forces respectively provided into a part of the panel to be deformed are oriented in the area of the nodes transversely or nearly transversely to those ribs which extend transversely to the curvature to be obtained and consistently tangentially to the panel part in the direction of curvature and following change of curvature on account of bending; and servo motor means for pivoting the members for thereby varying the direction of force action as provided by said deforming members into the panel part such that these forces as provided by said two deforming members do not have to act coaxially in relation to each other.

10. The improvement as in claim 9, there being a common armature element, said deforming members being separately pivoted on said armature.

11. The improvement as in claim 10, each of said deforming members having its own pivot mount on said common armature.

12. The improvement as in claim 11, including means for changing the distance between the pivot mounts to thereby adapt the device to different distances between adjacent nodes of the stiffening ribs.

13. The improvement as in claim 11, including means for changing the pivot radius of the deforming members on the respective pivot mounts and in relation to the action point of the deforming members on the panel.

14. The improvement as in claim 9, said deforming members carrying clamping bracket pairs for engagement of adjacent nodes, said clamping bracket pairs being freely pivotable under utilization of pivot pins arranged transversely to the plane of pivoting.

15. Device for the bending and deformation of panels for covering cells of vehicles in the aerospace industry, said panels having inwardly directed stiffening ribs which intersect in nodes, the device having first and second deforming members being capable of engaging said panel in points adjacent to nodes under consideration of length changes obtained by some of the ribs; the improvement comprising:

said deforming members carrying clamping bracket pairs for engagement of adjacent nodes, said clamping bracket pairs being freely pivotable under utilization of pivot pins arranged transversely to the plane of pivoting;

means connected to said device for applying force to the deforming members so that the deforming members are enabled to deform and bend said panel;

support means with two pivot means for mounting said two deforming members in relation to each other such that the deforming forces respectively provided into the respective panel to be deformed are oriented in the area of the nodes transversely or nearly transversely to those ribs which extend transversely to the curvature to be obtained and consistently tangentially to the panel in the direction of curvature and following change of curvature on account of bending; and means for varying a spacing between the two pivot means, to thereby vary the direction of force action as provided by said deforming members into the panel such that these forces as provided by said two deforming members do not have to act coaxially in relation to each other.

16. The improvement as in claim 15, said means for applying force including a servo motor pivotally mounted and connected to said deforming members.

* * * * *